US007140305B2

(12) United States Patent
Christians

(10) Patent No.: US 7,140,305 B2
(45) Date of Patent: Nov. 28, 2006

(54) FOLDING TABLE WITH COMPOSITE PEDESTAL BASE

(75) Inventor: Robert D. Christians, 14225 SW. 125th Ct., Miami, FL (US) 33186

(73) Assignee: Robert D. Christians, Homestead, FL (US)

( * ) Notice: Subject to any disclaimer, the term of this patent is extended or adjusted under 35 U.S.C. 154(b) by 228 days.

(21) Appl. No.: 10/887,607

(22) Filed: Jul. 9, 2004

(65) Prior Publication Data

US 2006/0005748 A1 Jan. 12, 2006

(51) Int. Cl.
*A47B 3/00* (2006.01)

(52) U.S. Cl. ..... 108/115; 108/79

(58) Field of Classification Search ..... 108/115, 108/88, 166, 167, 169, 178, 18, 174, 175, 108/176, 179, 12, 17, 83, 85, 69, 77, 79
See application file for complete search history.

(56) References Cited

U.S. PATENT DOCUMENTS

| | | | | | |
|---|---|---|---|---|---|
| 1,099,780 | A * | 6/1914 | Weeks | 108/83 |
| 1,472,575 | A * | 10/1923 | Anderson | 108/79 |
| 1,516,323 | A * | 11/1924 | Bilton | 108/79 |
| 2,890,089 | A * | 6/1959 | Sanchez | 108/79 |
| 3,029,114 | A * | 4/1962 | Sanchez | 108/79 |
| 3,308,773 | A * | 3/1967 | Long | 108/79 |
| 3,473,492 | A * | 10/1969 | Sanchez | 108/79 |
| 3,520,259 | A * | 7/1970 | Sanchez | 108/79 |
| 3,606,845 | A * | 9/1971 | Hickman | 108/169 |
| 3,817,191 | A * | 6/1974 | Hansen et al. | 108/79 |
| D252,965 | S * | 9/1979 | Petersen | D6/430 |
| 4,646,657 | A * | 3/1987 | Zollinger | 108/173 |
| 5,311,826 | A * | 5/1994 | Baggiani | 108/166 |
| 6,041,723 | A * | 3/2000 | Peterson | 108/115 |
| 6,431,091 | B1 * | 8/2002 | Chang | 108/115 |

* cited by examiner

*Primary Examiner*—Janet M. Wilkens
(74) *Attorney, Agent, or Firm*—John H. Faro, Esq.

(57) ABSTRACT

A folding expandable table having a composite pedestal. In the preferred embodiments of this folding table, retractable table legs are integrated within each member of the composite pedestal assembly, which serves to both store such legs and support table top leafs; and, as the table is unfolded, supports the table top with up to four leafs. The folding table can be partially or completed unfolded, to form three distinct configurations with one, two or four leafs.

4 Claims, 9 Drawing Sheets

FOLDING TABLE WITH COMPOSITE PEDESTAL BASE

BACKGROUND OF THE INVENTION

1. Field of the Invention

This invention relates to an article of manufacture. More specifically, this invention relates to an expandable folding table having multiple configurations. In the preferred embodiments of this folding table, retractable legs of the table are integrated within a member of composite pedestal assembly which serves to both store such legs and support table top leafs; and, as the table is unfolded, such legs are deployed from each member of the composite pedestal to support the expandable table top as each leaf thereof is progressively unfolded.

2. Background of Invention

Folding tables are known in the art, and typically include two planar tops surfaces (herein also "leafs") hingedly attached to one another. Generally, the table legs are affixed to the corners of the unfolded table, and are similarly extended or retracted from the underside of the table top of the folding table, e.g. U.S. Pat. No. 2,158,950 (to Swett, issued Jun. 6, 1938)

U.S. Pat. No. 3,606,845 (to Hickman, issued Apr. 21, 1969) is representative of a genre of folding table wherein the legs are hingedly attached to a pedestal In the Hickman design, his folding table is provided with a pedestal base (Ref. no. 24), that serves to both support an unfolded leaf pair from the middle of the table, and store such leaf pair when not in use (folded). The Hickman concept also incorporates a fixed leaf (Ref. no. 18) which is located on the top of the pedestal, and fills the gap between each leaf as the table is unfolded.

U.S. Pat. No. 3,005,670 (to Schultz, issued Feb. 25, 1960) is similar to Hickman, in that two pair of collapsible leafs of the Schultz folding table, are stored within a pedestal-like base. Insofar as the Schultz design contemplates a four leaf design, without any support thereof in the center of the table, Schultz requires the addition of "guide means" and "groove defining strips" (FIG. 5, ref. nos. 30 & 32) to support the pair of interior leafs in the center of his table. Each of the "guide means" and "groove defining strips" are intended to provide rigidity and structural support to the pair of interior leafs table at the center line/hinge between them.

U.S. Pat. No. 6,314,892 (to Favini, issued Nov. 13, 2001) is similar to Schultz, in that the Favini folding table comprises two leafs hingedly attached to one another along a common edge. One of these leafs is also hingedly attached to a pedestal at a location off-set from the center of the table. The Favini table can be deployed with either one or both of the leafs, In order to provide improved support for these leafs, at the time of unfolding thereof, Favini also provides a pedestal base which includes a pair of folding leg assemblies to support each leaf. Each pair of leg assemblies is also unfolded from the pedestal, and thereby supports both ends of the table, while the pedestal provides support at the center thereof.

In each of the folding tables described hereinabove, the table top assembly can be supported either from each end of the unfolded table, or alternatively, by means of legs which are integral with a pedestal base. Where the table top is not support by a pedestal, or by a comparable leg assembly, some other expedient is generally required to prevent the table top from sagging along the center-line/hinge between the two leafs, U.S. Pat. No. 4,646,657 (to Zollinger, issued March 1987) is representative of an alternative means for achieving such table top support along this center/hinge-line without the use of a pedestal or legs.

In each of the foregoing folding table designs disclosed in the prior art, the use of more than two leafs is generally circumscribed because of the physical limitations inherent is such designs. The Zollinger patent recognizes this limitation and attempts to accommodate the need for physical support along a center/hinge-line by a lock/bolt mechanism that telescopes from one leaf into the adjacent leaf. This telescoping bolt does not, however, provide sufficient support to the abutting leafs to accommodate heavy loads, and is otherwise complex to manufacture and subject to damage and jamming. Accordingly, there continues to exist a need to provide a folding table with more than two leafs with the physical integrity of Hickman and/or Favini design, and yet is readily collapsible for ease of storage and/or transport.

OBJECTS OF THE INVENTION

It is the object of this invention to remedy the above as well as related deficiencies in the prior art.

More specifically, it is the principle object of this invention to provide a folding table having up to four folding panels (leafs) stored within a composite pedestal.

It is another object of this invention to provide a folding table wherein each leaf of leaf pair is supported by a leg assembly that is associated with a member of a composite pedestal.

It is yet another object of this invention to provide a folding table wherein each leaf of leaf pair is also supported by a member of a composite pedestal.

Additional objects of this invention include a method for supporting a folding table having two pair of leafs.

SUMMARY OF THE INVENTION

The above and related objects are achieved by providing a folding table having two pair of leafs hingedly attached to one another along at least one common edge thereof, so as to form a table having at least one, and no more than four leafs, upon unfolding thereof. The four leafs of the folding table of the instant invention are arranged, relative to one another, in a linear array, and further characterized in reference to their relative position along this linear array as having one pair on each of such array as the outer leaf pair, and the two remaining leafs being characterized as the interior leaf pair.

In the preferred embodiments of this invention, the folding table comprises a leaf support assembly having at composite pedestal, wherein each member of the composite includes a pair of legs that extend from or retract into each member of the composite. The composite pedestal is further provided with a filler panel or removable cap that is used to couple each member of the composite to the other, when only one or both leafs, of the outer leafs pair, is unfolded. Conversely, the filler panel, or removable cap, can be readily removed, and thereby permit separation of each member of the composite pedestal. Such separation is accompanied by unfolding of each member of the interior leaf pair, so as to fully unfold the table to the full extent of a four leaf array. Thus, the folding table can be used with as few a one leaf, or as many as four leafs, while providing support for each leaf independent of the other.

DESCRIPTION OF THE INVENTION INCLUDING PREFERRED EMBODIMENTS

Figure 1:
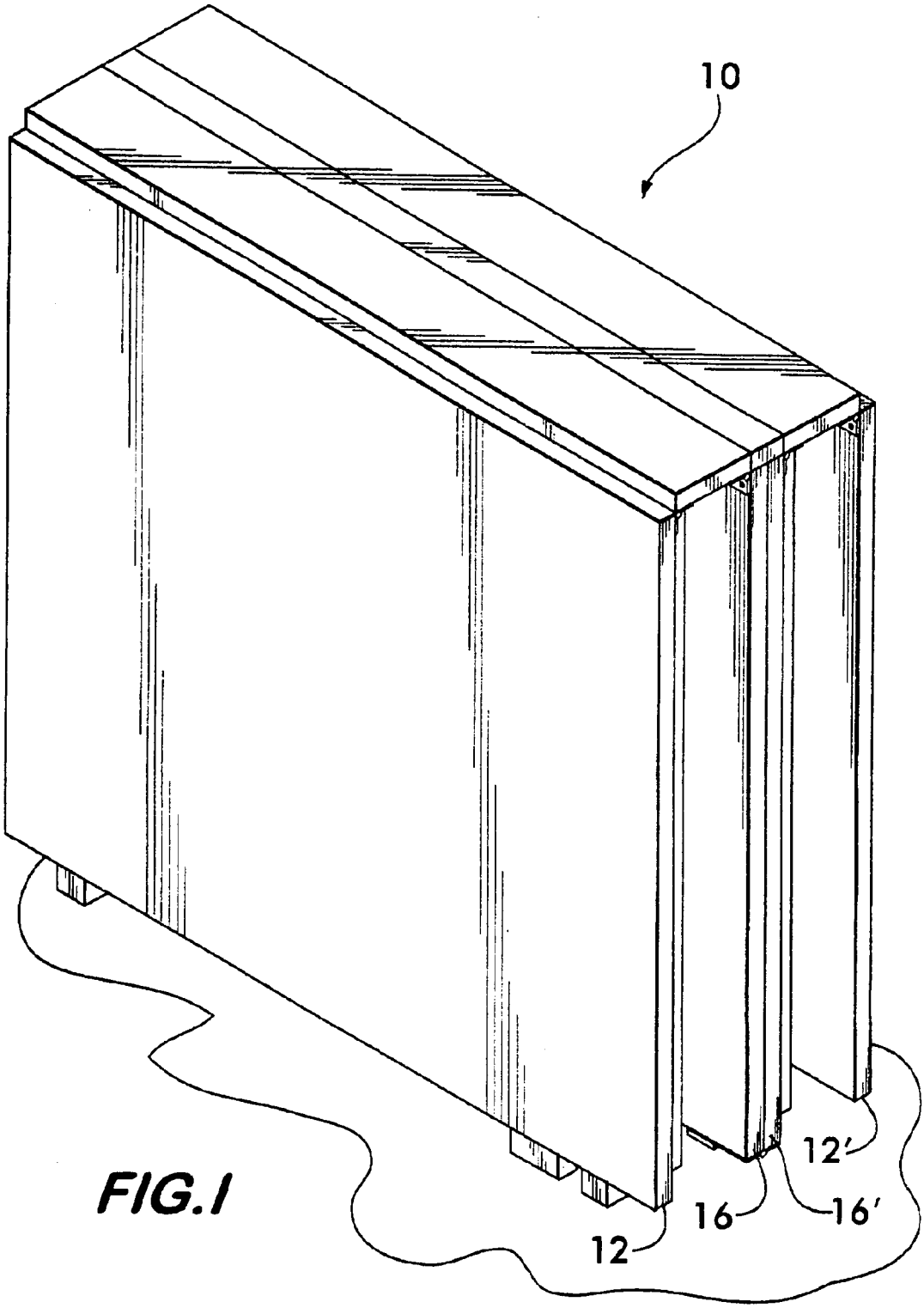
FIG. 1 is perspective view of the preferred embodiment of the folding table of this invention, as fully folded, when viewed from the side.

The Figures which accompany this application, and referenced herein, depict a representative folding table of this invention. In the embodiments of this invention illustrated in these Figures, the elements appearing in each of the foregoing Figures, and which are common to more than one Figure, are assigned a common reference numeral for each of understanding and economy of expression.

Figure 2:
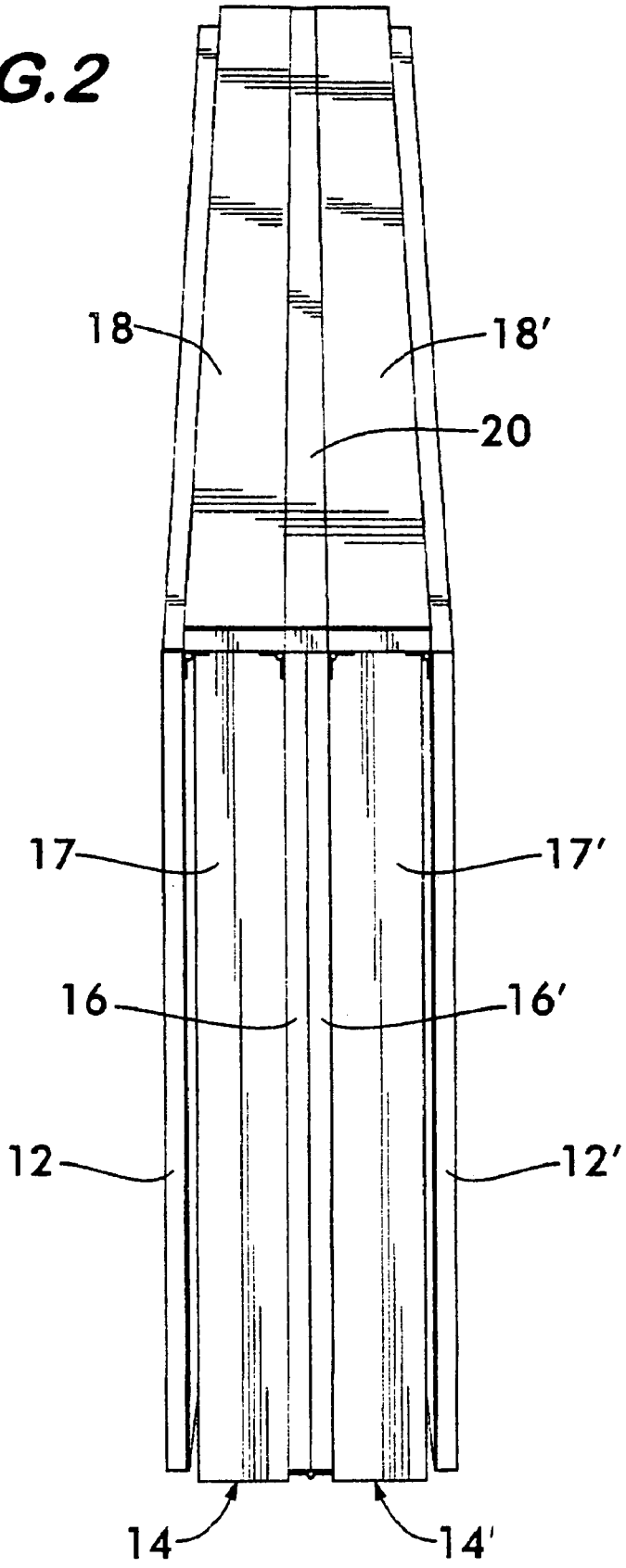
FIG. 2 is perspective view of the preferred embodiment of the folding table of this invention, as fully folded, when viewed from one end thereof.

FIG. 1 depicts a preferred embodiment folding table (10) of this invention, as it appears in a fully folded and storage configuration. As depicted therein, the table (10) comprises a composite pedestal, and one leaf of an outer leaf pair (12, 12') attached to one member of the composite pedestal (14, 14'); and, as illustrated in FIG. 2, one leaf of an interior leaf pair (16, 16') attached to one member of the composite pedestal (14, 14'). In the depiction of the folding table in FIG. 2, each member of the composite pedestal includes a separate permanent cap, and a removable or common coupling insert that holds each member of the composite pedestal contiguous with and in a fixed position relative to the other.

Figure 3:
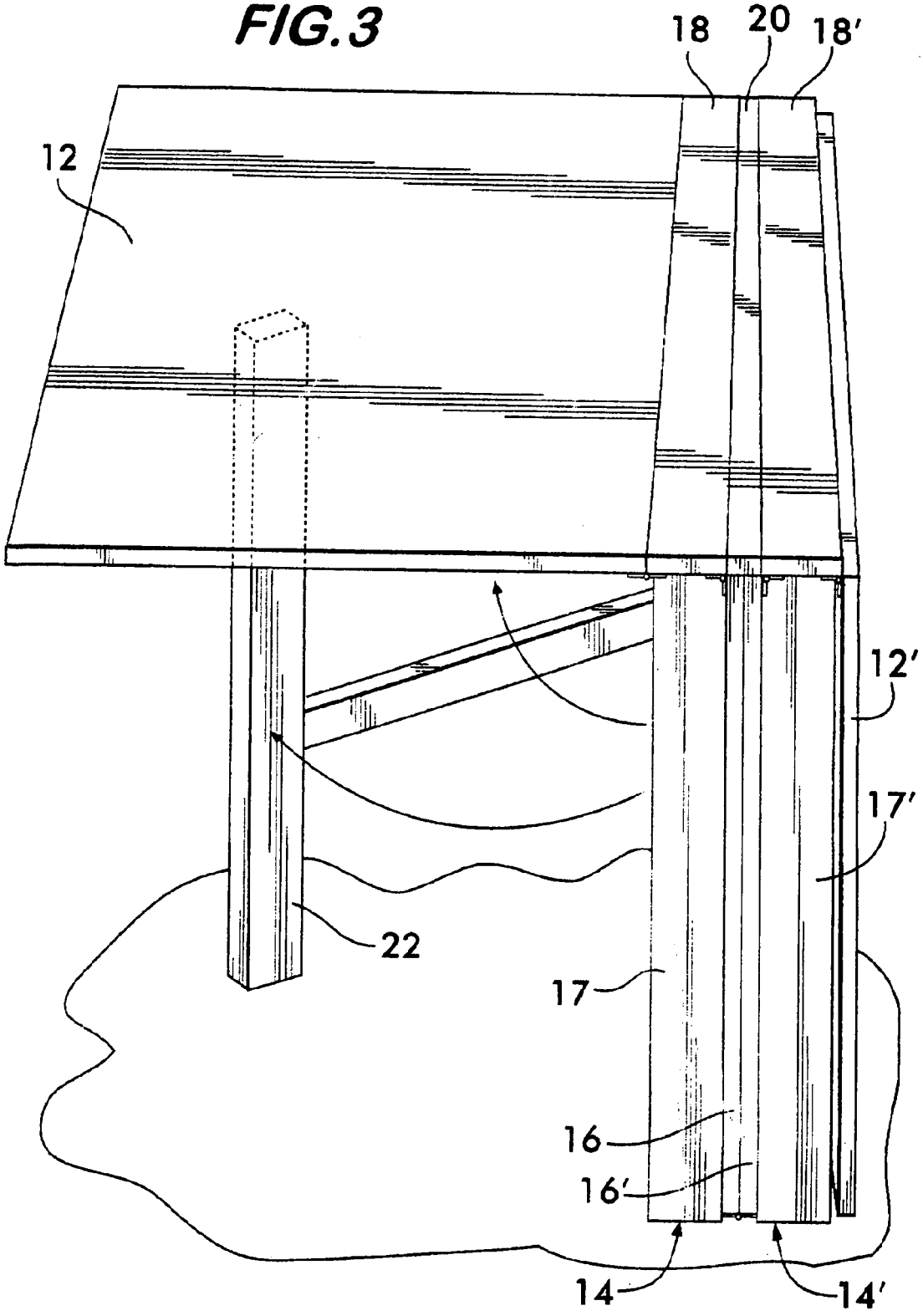
FIG. 3 is perspective view of the preferred embodiment of the folding table of this invention with one leaf of the out leaf pair unfolded.
Figure 4:
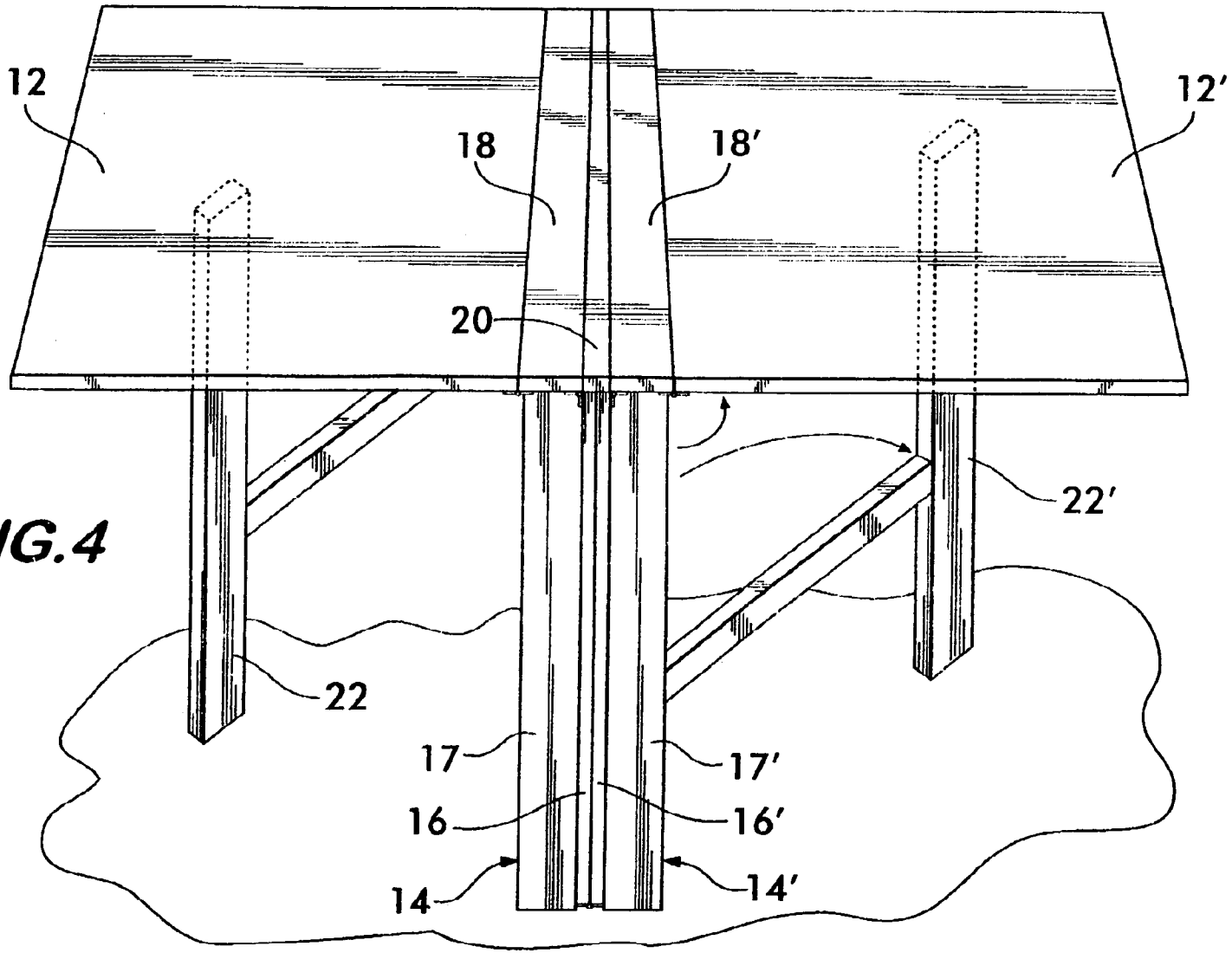
FIG. 4 is perspective view of the preferred embodiment of the folding table of this invention with both leafs of the outer leaf pair unfolded.

When, as is shown in FIG. 3, an outer leafs (12, 12') of the folding table is opened/extended, a leg (22, 22') is also deployed from each member (14, 14') of the pedestal composite to support the opened/extended leaf (12, 12'). This process can be repeated until both of the leafs are opened/extended leaf, as depicted in FIG. 4. Each leaf (12, 12'12, 12') of the outer leaf pair of the folding table depicted in FIG. 4 is firmly supported by both one member (14, 14') of the composite pedestal, and by one leg (22, 22') that has been deployed from the corresponding member of the composite pedestal.

The table top end (15, 15') of each fixed frame (17, 17') of each member of the composite pedestal (14, 14') is provided with a permanent cap (18, 18') of essentially same composition, thickness and finish as each of folding leafs. The permanent caps (18, 18') and a coupling insert (20)—described hereinafter in the description of FIG. 6—combine to fill the gap in the table top between each of the leafs, as the table is unfolded.

Figure 5:
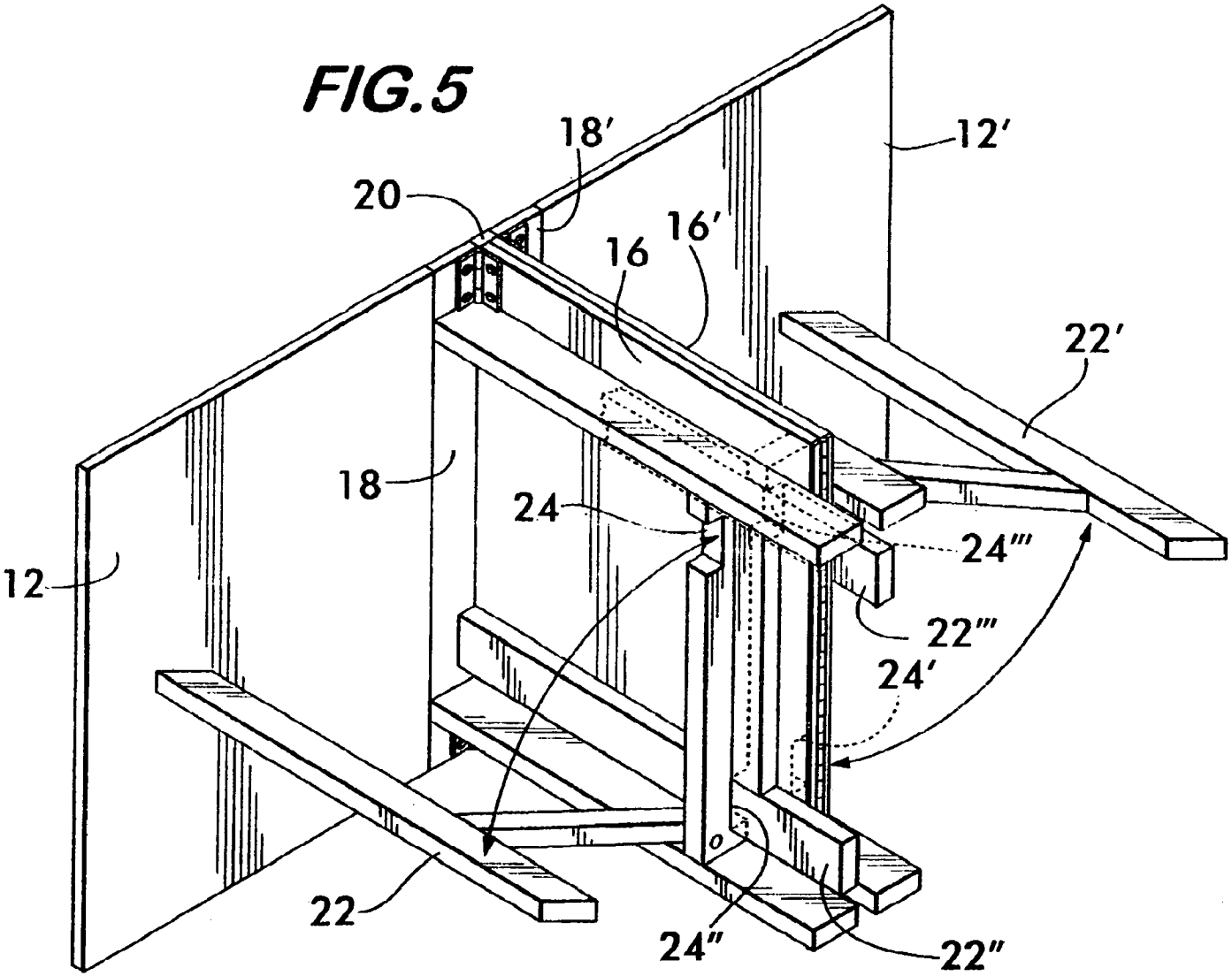
FIG. 5 is a perspective view of the folding table of FIG. 4, when viewed from below the table top.

FIG. 5 further illustrates the manner of deployment of the legs from within the composite pedestals of the table of FIG. 4. As depicted therein, each member of the composite pedestal (14, 14') is provided with a pair of complimentary recesses (24, 24', 24", 24'") to afford complete integration of the table legs into the pedestal upon collapse/folding of the table leaf during storage; or, allow for deployment of only one leg of each member of the composite when only the outer pair of leafs are unfolded.

Figure 6:
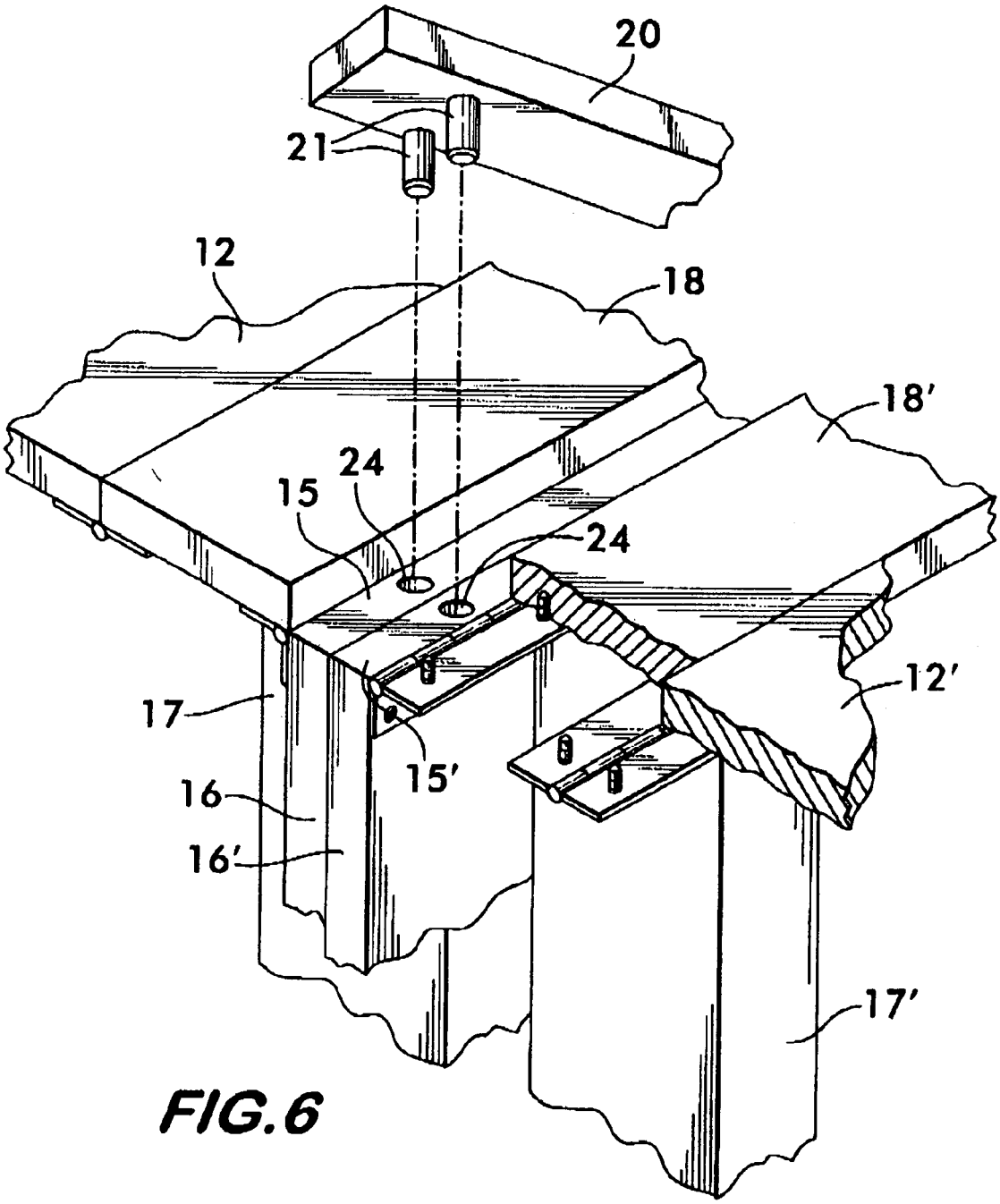
FIG. 6 is an enlarged and isolated view of the center of the folding table of FIG. 4, with the coupling insert removed from the top of the composite pedestal.
Figure 7:
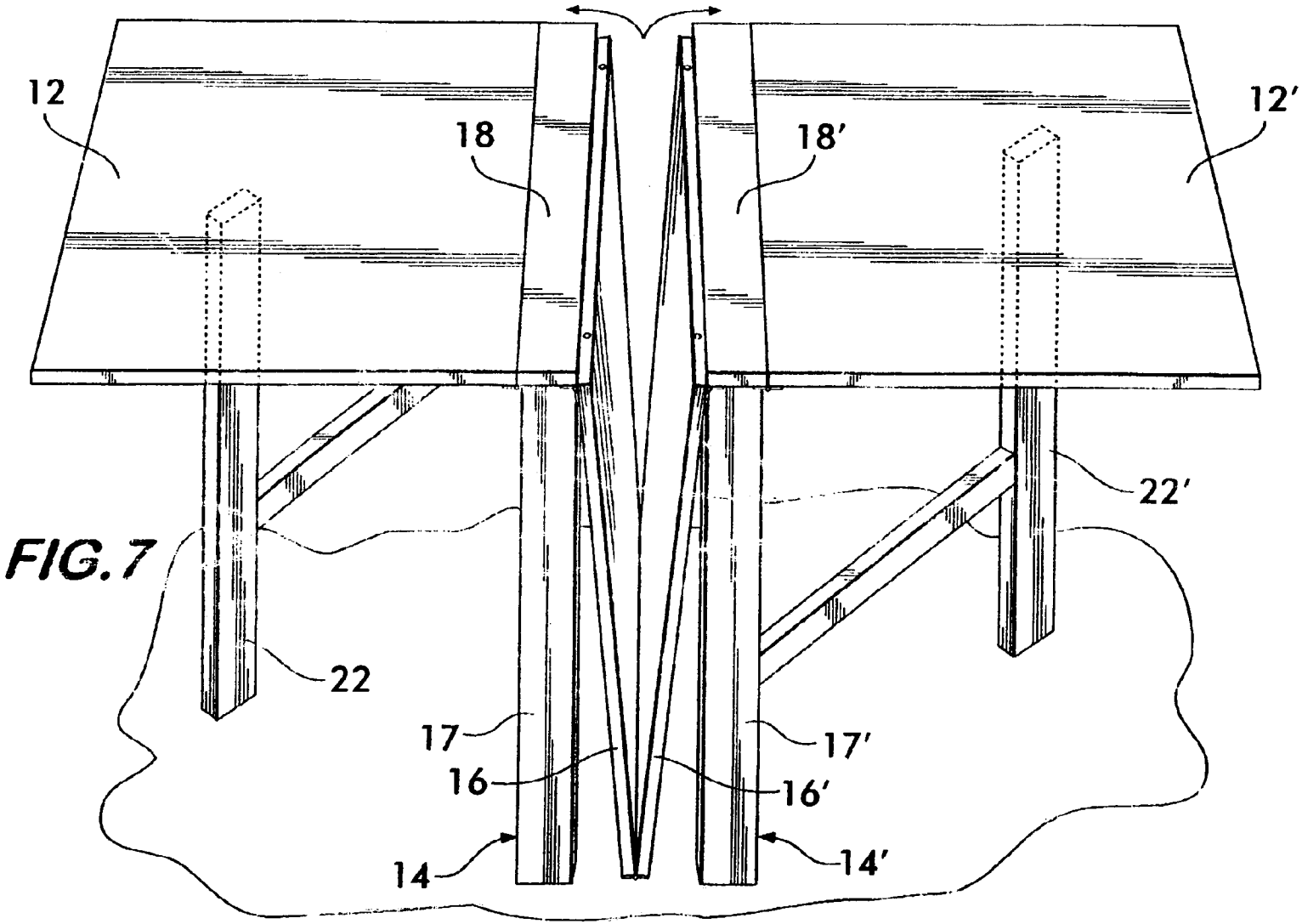
FIG. 7 is perspective view of the folding table of FIG. 4 as the interior pair of leafs are unfolded.
Figure 8:
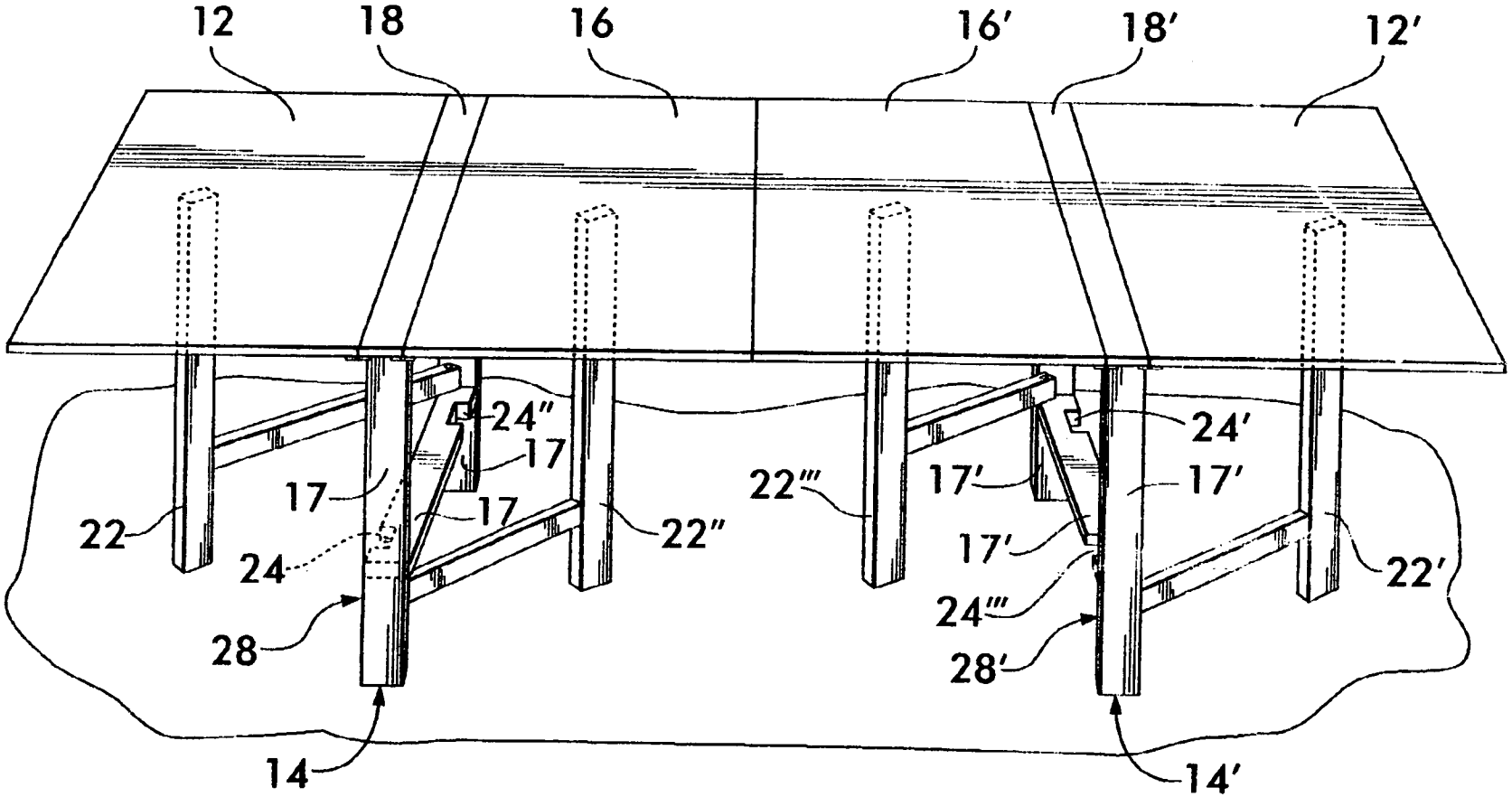
FIG. 8 is perspective view of the folding table of FIG. 4 with all four leafs of the table unfolded.
Figure 9:
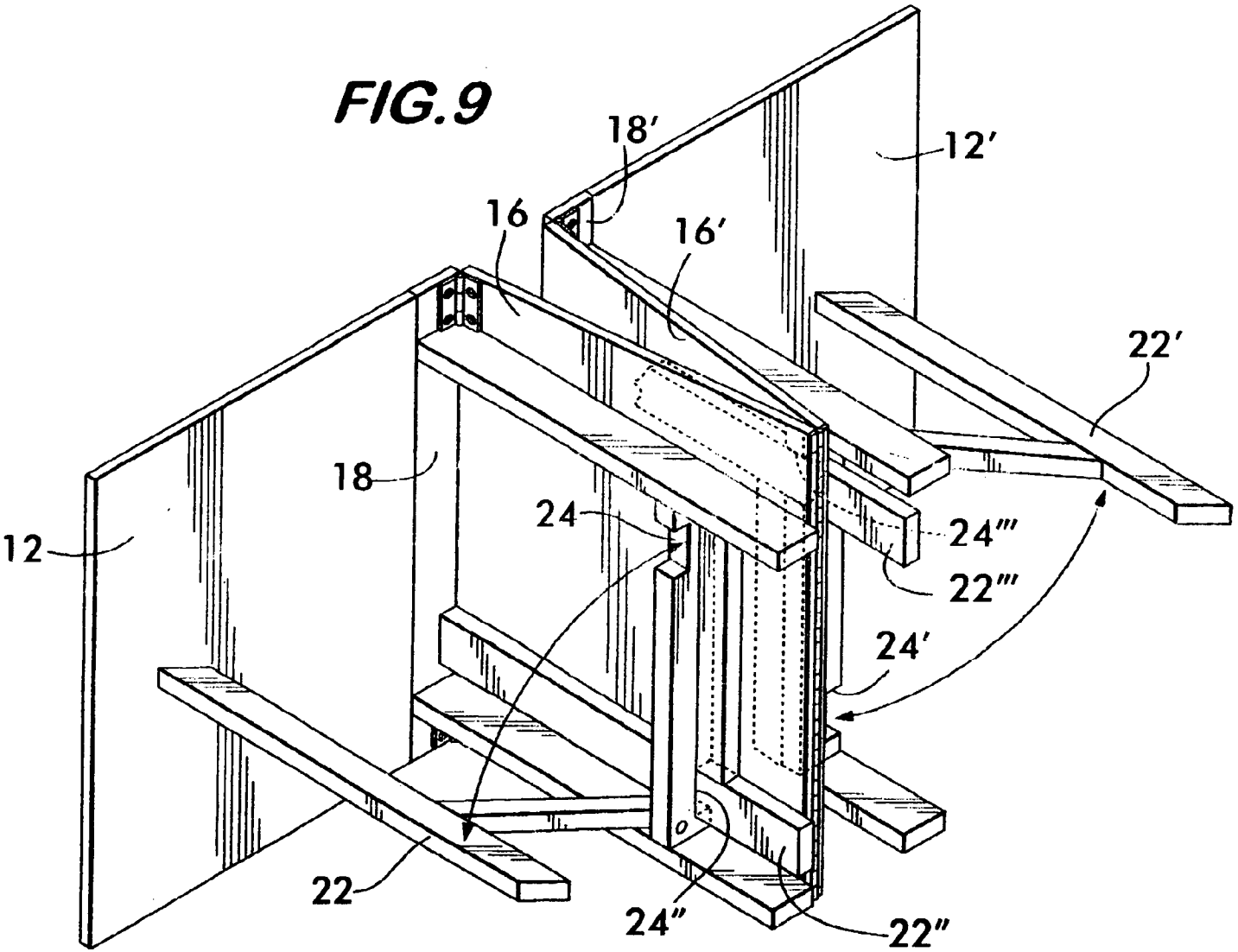
FIG. 9 is a perspective view of the folding table of FIG. 7, when viewed from below the table top.

FIG. 6 is an enlarged view of the table of FIG. 4 with the coupling insert (20) is removed. This coupling insert (20) is essentially the same thickness as the caps on each member of the composite pedestal. This coupling insert (20), as shown in FIG. 6, comprises a panel/plank of essentially the same composition and finish as the leafs of the folding table. This insert also includes, on the underside thereof, a number of pegs or dowel-like posts (21) that are affixed to the underside thereof and mate with a number of complimentary recesses/holes (24) arranged along the table top end (15, 15') the fixed frame (17,17') of each member of the pedestal assembly (14, 14'). When this coupling insert (20) is in place, each member of the pedestal assembly is retained in juxtaposition relative to the other; and, conversely, upon removal thereof, as shown in FIG. 6, each member of the composite pedestal is permitted to separate from the other, thereby permitting further unfolding of the interior table leafs (16, 16') and thereby increasing the table top by two additional leafs. FIG. 7 shows the progressive unfolding of the table of FIG. 4, upon removal of the coupling insert. FIG. 8 depicts the table of FIG. 7 to the full extent of unfolding of the interior leaf pair (16, 16'). Each leaf (16, 16') of the interior leaf pair of the table of FIG. 7 are also fully supported by a member of the composite pedestal (14, 14') and a leg (22", 22'") that has been deployed from within the fixed frame (28, 28') of the corresponding member of the composite pedestal. FIG. 8 depicts each of the legs of each member of the composite pedestal. As the table top is fully unfolded, two legs are deployed, in opposite direction, from each member of the composite pedestal and, thus, each leaf is fully supported by one leg and a pedestal member without need for mechanical devices or contrivances to further lock one leaf to the other.

The table of FIG. 8 can be progressively folded by simply reversing the foregoing process. More specifically, where the objective is to reduce the size of the folding table to two leafs, each of the legs that are deployed relative to an interior leaf (16, 16') is retracted into the pedestal from which it came/nests, the interior leafs allowed to return to their folded position, and the coupling insert replaced. At this juncture, the coupling insert/retaining cap (20) can be re-installed to maintain each member of the composite pedestal in juxtaposition relative to the other. Thus, the folding table is reduced in size from four leafs to the two leaf configuration. When it is time to put the folding table back in storage, each of the legs supporting an outer leaf is also retracted into a member of the composite pedestal from which it came/nests, and the out leaf allowed to return to it folded configuration relative to the composite pedestal.

The folded table, in this compact configuration, can be readily stored or transported for use in business of recreation. Multiple configurations of the folding table of this invention are also within the spirit and scope of this invention. In such multiple configurations, an additional composite pedestal module would be provided wherein the additional composite pedestal would also have two leafs associated therewith. One of the leafs of this additional module would be hingedly attached to one leaf of the outer pair of the basic folding table concept described and illustrated herein and, thereby, extend or expand the linear surface array of basic folding table construct by two more leafs.

Other modification and enhancements to the foregoing folding, consistent with its intended usage, are thus also within the contemplation and spirit of this invention. The foregoing description and accompanying drawing are, thus, intended as simply illustrative of a number of preferred embodiments of this invention, and not otherwise intended as delineating its scope, which is set forth in the claims that follow.

What is claimed is:

1. In a folding table have a pedestal and a leaf pair hingedly attached to said pedestal, wherein the improvement comprises:

(a) a composite pedestal having at least two modules, each module including a fixed frame of a defined thickness, a table top end and table base end, which supports the pedestal, and a pair of folding leafs hingedly affixed to said fixed frame of each of said module along the table top end thereof, one folding leaf of each leaf pair being further hingedly affixed to another folding leaf from another leaf pair along an edge opposite to said edge which is affixed to said fixed frame of of each said module, said fixed frame of each of module including a pair of retractable legs, each of said legs being pivotally fastened to and stored within said frame, so as to be freely movable into and out of said frame to support a leaf of said leaf pair upon unfolding thereof relative to said module, and (b) a table top cap permanently affixed to said table top end of said pedestal frame, said table top cap comprising a section of material having essentially the same composition, appearance and thickness as said composition, appearance and thickness of said folding leafs, and, a surface area dimension essentially coincident with said table top end of said frame, (c) a removable retaining cap for maintaining each module of said composite pedestal in fixed position relative to the other, said retaining cap comprising a length of material having essentially the same composition, appearance and thickness as said composition, appearance and thickness of said folding leaf, and, a surface area dimension essentially coincident with said hinged edge of said folding leaf, said retaining cap being further characterized as being provided with coupling means, on the underside surface thereof, for engagement with a complimentary member on said table top end of said fixed frame of each of said modules of said composite pedestal, so as to maintaining each of said module of said composite pedestal in juxtaposition relative to the other until removed.

2. The folding table of claim 1, wherein said frame of each of said module includes a complimentary recess for each said retractable leg, so as to accommodate retraction and storage of said retractable legs within said frame of said module.

3. The folding table of claim 1, wherein said coupling means of said retaining cap includes a plurality of posts for engagement of a series of complimentary recesses within said table top end of said frame of each said module of said composite pedestal.

4. The folding table of claim 1, wherein said folding table includes three modules.

* * * * *